US011385023B1

(12) United States Patent
Hayman

(10) Patent No.: US 11,385,023 B1
(45) Date of Patent: Jul. 12, 2022

(54) RAPID ACCESS FIREARM SAFE

(71) Applicant: Hayman Safe Company, Inc., Oviedo, FL (US)

(72) Inventor: Gary Hayman, Mount Dora, FL (US)

( * ) Notice: Subject to any disclaimer, the term of this patent is extended or adjusted under 35 U.S.C. 154(b) by 0 days.

(21) Appl. No.: 17/485,328

(22) Filed: Sep. 25, 2021

Related U.S. Application Data

(63) Continuation-in-part of application No. 15/929,551, filed on May 8, 2020, now Pat. No. 11,131,137.

(60) Provisional application No. 62/845,219, filed on May 8, 2019.

(51) Int. Cl.
*F41C 33/06* (2006.01)
*E05B 65/00* (2006.01)

(52) U.S. Cl.
CPC ..... *F41C 33/06* (2013.01); *E05B 65/0075* (2013.01)

(58) Field of Classification Search
CPC .. Y10T 70/5031; F41C 33/06; E05B 65/0075; E05B 1/026; E05G 1/00; E05G 1/005; E05G 1/02; E05G 1/024; E05G 1/04; E05G 2700/00; E05G 2700/02
USPC ..... 109/23; 70/63; 224/912, 913; 42/70.01, 42/70.11; 206/317; 211/64
See application file for complete search history.

(56) References Cited

U.S. PATENT DOCUMENTS 784,601 A 3/1905 Taylor
3,464,606 A 9/1969 Nordeen
4,532,870 A 8/1985 Hayman
4,788,838 A * 12/1988 Cislo ..... F41C 33/06 5/503.1
5,056,342 A 10/1991 Prinz
5,118,175 A * 6/1992 Costello ..... E05G 1/02 312/271
5,161,396 A 11/1992 Loeff
5,164,718 A 11/1992 Cedergren
5,329,865 A 7/1994 McWard
5,503,088 A 4/1996 Hayman
5,683,021 A 11/1997 Setina
5,701,770 A 12/1997 Cook et al.
5,987,941 A 11/1999 Zocco
6,405,861 B1 6/2002 Siler et al.
6,843,081 B1 1/2005 Painter
(Continued)

OTHER PUBLICATIONS

AMSEC American Security, <https://residential.amsecusa.com/residential-gun-safes/>, Accessed May 5, 2021, Published at least as early as May 5, 2021, 4 Pages.
(Continued)

*Primary Examiner* — Lloyd A Gall
(74) *Attorney, Agent, or Firm* — John J. Bamert, Esq.; Bamert Regan

(57) ABSTRACT

A rapid access firearm safe having a rigid body with a secure interior storage compartment and a door for accessing a firearm. The door is hingedly attached to the lower portion of the body such that the door swings open from an upper portion of the body, and a firearm retaining mechanism is located on the interior side of the door and releasably holds at least one firearm thereto. A locking mechanism is integrated into the upper portion of the safe body and accessible from the exterior, and the locking mechanism selectively holds the door firmly against the body thereby securely enclosing the interior storage compartment and releases the door from the body upon deactivation by receiving user input.

12 Claims, 7 Drawing Sheets

(56) References Cited

U.S. PATENT DOCUMENTS

| | | | | |
|---|---|---|---|---|
| 6,845,640 | B2 | 1/2005 | Loeff et al. | |
| 7,047,771 | B2 | 5/2006 | Tanos | |
| 7,159,711 | B1 | 1/2007 | Gardner | |
| 7,434,427 | B1 * | 10/2008 | Miresmaili | F41C 33/06 42/70.11 |
| 7,877,920 | B2 | 2/2011 | Szuminski et al. | |
| 8,104,313 | B2 | 1/2012 | Wolfe | |
| 8,726,704 | B2 * | 5/2014 | White | E05B 37/20 70/276 |
| 8,752,745 | B2 | 6/2014 | Bond et al. | |
| 10,180,303 | B2 | 1/2019 | Gilbert et al. | |
| 10,253,529 | B1 | 4/2019 | McGinn | |
| 10,591,248 | B1 | 3/2020 | Christiansen | |
| 11,131,137 | B2 * | 9/2021 | Hayman | E05B 49/00 |
| 2004/0104137 | A1 * | 6/2004 | Schonenbach | F41C 33/06 206/317 |
| 2004/0144664 | A1 | 7/2004 | Hammill | |
| 2005/0115912 | A1 * | 6/2005 | Szuminski | A47B 81/005 206/315.11 |
| 2005/0133473 | A1 * | 6/2005 | Lesperance | A47B 81/005 211/64 |
| 2006/0065560 | A1 | 3/2006 | Dickenson et al. | |
| 2007/0170128 | A1 * | 7/2007 | Punzel | A47B 81/005 211/64 |
| 2007/0170129 | A1 * | 7/2007 | Punzel | F41A 23/18 211/64 |
| 2012/0193254 | A1 | 8/2012 | Kubiniec | |
| 2014/0027394 | A1 * | 1/2014 | Stepp | E05G 1/00 211/64 |
| 2015/0101516 | A1 | 4/2015 | Suggs | |
| 2015/0260480 | A1 * | 9/2015 | Dunn | E05G 1/00 42/70.11 |
| 2015/0366344 | A1 * | 12/2015 | Suggs | A47B 46/00 312/291 |
| 2016/0095432 | A1 * | 4/2016 | Wirthlin | A47B 81/005 211/64 |
| 2016/0201379 | A1 * | 7/2016 | Dutra | E05B 65/0075 312/224 |
| 2016/0208542 | A1 * | 7/2016 | Coons | E05G 1/005 |
| 2016/0223290 | A1 * | 8/2016 | Jacob | F41C 33/06 |
| 2017/0072864 | A1 * | 3/2017 | Fife | B60R 7/043 |

OTHER PUBLICATIONS

Rapid Access Firearm Safe, Hayman Safe Company, Inc., <https://www.haymansafe.com/RAFS.html>, Accessed Sep. 24, 2021, Published at least as early as Sep. 24, 2021, 2 pages.

* cited by examiner

RAPID ACCESS FIREARM SAFE

CROSS-REFERENCE TO RELATED APPLICATIONS

This application is a continuation-in-part of U.S. patent application Ser. No. 15/929,551, filed May 8, 2020, now U.S. Pat. No. 11,131,137, titled "RAPID ACCESS FIREARM SAFE", which claims the benefits of U.S. Provisional Application No. 62/845,219, filed May 8, 2019, the entirety of each of which is incorporated herein by reference.

FIELD OF THE INVENTION

The present invention generally relates to safes and reinforced storage cabinets and devices. More particularly, the present invention relates to a safe that provides secure storage of firearms while also allowing rapid access to the firearms secured therewithin.

BACKGROUND OF THE INVENTION

Firearm safes and strongboxes are well known and used to store firearms and ammunition in a secure environment. It is common to also have the firearm safe be fire proof to protect the contents. These safes and strongboxes can have a variety of securing means to access the interior, and such securing means can be slowly accessible such as a combination dial, or quickly accessible, such as a keypad or biometric lock. When rapid access to stored firearms is desired, a fast access lock mechanism is used for the firearm safe or strongbox.

Unfortunately, acts of public violence have been increasing in modern times. Mass shootings at public fora have increased, and even occur at educational institutions. Educational institutions in the United States, such as secondary schools and universities, now have police officers and "resource officers" that work at the institution and who can carry and handle firearms. These officers are in place to handle potential violence, including a shooting attack.

In the instance of a shooting attack, it is desirable for an officer to have access to larger and more powerful firearms, such as shotguns and rifles. It is impractical for the resource officer to carry around large weapons at the educational institution so secure storage of those weapons in a gun safe or vault is normally done. However, if these weapons are needed by the officer, they are needed very quickly and any significant time that is needed to open the safe or vault could be catastrophic.

SUMMARY OF THE INVENTION

In summary, the present invention is a rapid access firearm safe that includes a rigid body, a locking mechanism, and a door that is hinged at the bottom and outwardly opens at the upper portion of the body. The interior of the door has means to hold firearms, which preferably can include at least one long gun such as a shotgun or rifle. The door can open automatically with the lock being deactivated, or can be pulled open once the lock is deactivated. The locking mechanism can be a biometric lock, or accept coded input from a person in order to be activated and/or at least be deactivated.

The safe is particularly advantageous to accommodate long guns and provide rapid access thereto by presenting the stock or pistol grip of the long gun immediately to a person opening the door of the safe. In one embodiment, the person accessing the safe can properly grasp the gun and trigger and use the firearm right after being pulled out of the safe. In other embodiments, the upper part of the long gun, such as the barrel grip/guard is the part of the gun immediately available for a person to grasp.

The invention achieves the above objectives, as well as other objectives and advantages that will become apparent from the description that follows, by providing a rapid access firearm safe. The safe includes a rigid body, a door, a lock, a firearm holder, an adjustable mount system, and a door-mount interface. The rigid body has an interior storage compartment and an exterior surface. The door is disposed within the body and defines a barrier portion. The barrier portion has an interior side facing the interior storage compartment and an exterior side. The lock is configured to selectively lock the door in a closed configuration relative to the body and to selectively unlock the door to enable the door to transition to an open configuration in which the door is free to move relative to the body. The firearm holder is configured to selectively hold a firearm in the interior storage compartment. The adjustable mount system is configured to selectively receive and secure the firearm holder at a variety of selectable positions on the adjustable mount system. A door-mount interface is coupled to the door and configured to selectively receive and secure the adjustable mount system to the interior side of the barrier portion at a variety of selectable positions on the door-mount interface. Accordingly, a variety of adjustable mounting positions for the firearm on the barrier portion is increased.

In some embodiments, the door defines a floor portion. In some embodiments, floor portion extends into the interior storage compartment from the barrier portion of the door and is configured to move with the barrier portion when the door swings open.

In some embodiments, the body has an upper portion and a lower portion. In some embodiments, the door is hingedly attached to the lower portion of the body such that the door swings open from the upper portion of the body.

In some embodiments, the firearm holder has hooks or loops, and the adjustable mount system has the other of hooks or loops. In some embodiments, hook-and-loop fasteners are configured to selectively couple the firearm holder to the adjustable mount system.

In some embodiments, the adjustable mount system has hooks or loops, and the door-mount interface has the other of hooks or loops. In some embodiments, hook-and-loop fasteners are configured to selectively couple the adjustable mount system to the door-mount interface.

In some embodiments, the firearm holder includes a holster or cup that is configured to removably hold a handgun. In some embodiments, the firearm holder includes a strap configured to extend across a stock end portion of the firearm with opposite end portions of the strap coupled to the adjustable mount system to removably hold the firearm. In some embodiments, the firearm is a shotgun or rifle, and no portion of the safe is configured to clamp or grip a barrel of the shotgun or rifle.

In some embodiments, the floor portion of the door is disposed below a barrel of the firearm and is configured to shield a distal opening in the barrel of the firearm from contents in the interior storage compartment as the door swings open.

In some embodiments, the adjustable mount system is larger than the firearm holder in at least one dimension, whereby a variety of adjustable mounting positions of the firearm holder on the adjustable mount system is increased, thereby increasing a variety of adjustable mounting positions for the firearm on the barrier portion.

In some embodiments, the door-mount interface is larger than the adjustable mount system in at least one dimension, whereby a variety of adjustable mounting positions of the adjustable mount system on the door-mount interface is increased, thereby increasing a variety of adjustable mounting positions for the firearm on the barrier portion.

In some embodiments, the door is spring biased toward the open configuration, whereby the door automatically opens responsive to unlocking the lock.

DETAILED DESCRIPTION

Figure 1:
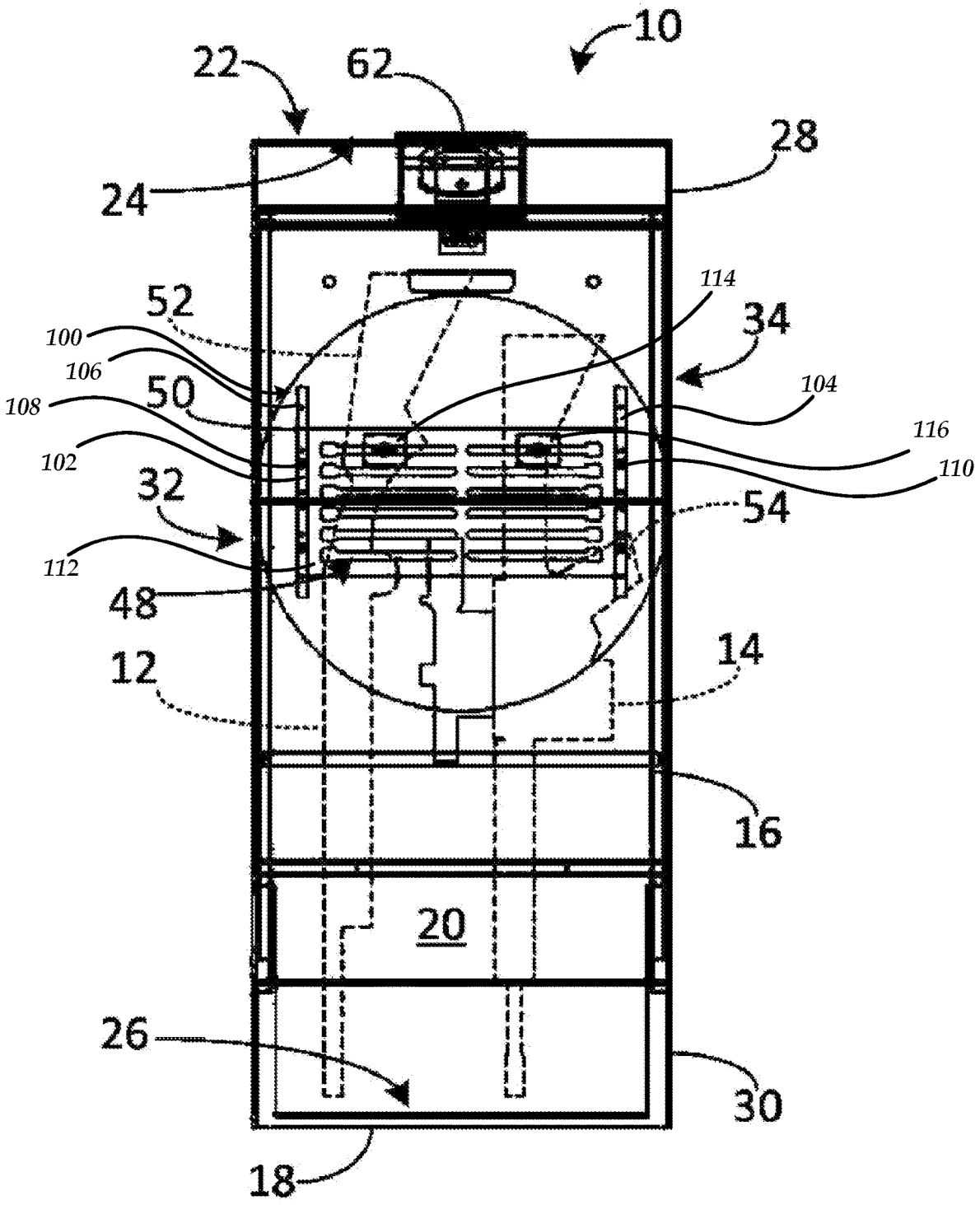
FIG. 1 is a front see-through view of the rapid access gun safe, with the long guns illustrated as being held in position on the door of the safe.

FIG. 1 is a front see-through view of the rapid access firearm safe 10, with the long guns 12,14 illustrated in position on the door 16 of the safe 10. Shown as long guns in outline here is a shotgun 12 and a rifle 14. The rapid access firearm safe 10 has a rigid cubicle body 18 having an interior storage compartment 20 and an exterior surface 22. The body 18 further has a top wall 24 at the upper portion 28 of the body 18, a bottom wall 26 at the lower portion 30 of the body, and at least four side walls 32,34,36,38, as illustrated between FIGS. 1 and 2A.

The rigid body 18 can have any shape, not solely cubicle, but it is preferred that the shape assist in maintaining the structural integrity and rigidity of the safe 10. The rigid material making the body 18 can be metals, such as iron, steel, or alloys, or alternately, rigid polymers or ceramics. It is preferable that the body 18 be at least 36 inches tall (1 meter) to accommodate longer guns on the interior side 40 of the door 16. It should be noted that the door 16 can be flush or slightly recessed from the body 18. The material should be sufficiently strong enough to resist attempts to drill or break into the safe 10. The material can also be inflammable such that the safe 10 can withstand fire and significant temperature to be either fire-resistant or fireproof. Moreover, as is known in the art, the safe 10 can be bolted to or affixed to the ground and/or a wall such that the safe 10 cannot be dislodged or easily moved.

With reference again to FIGS. 1 and 2A, there is a door 16 within a side wall 38 of the body 18, the door 16 having an interior side 40 thereof facing the interior storage compartment 20 and an exterior side 42 (this can the front edge of the body 22 if the door 16 is recessed) thereof. The door 16 is hingedly attached (here, at hinge 44 which is inset in a recess in side wall 38 of the body 22) to the lower portion 30 of the side wall 38 of the body 18 such that the door 16 swings open from the upper portion 28 of the body 18, as is shown through FIGS. 2A to 2C, with the door 16 held firmly against the body 18 in FIG. 2A to being partially open in FIG. 2B to fully open and away from the upper portion 28 of the body 18 in FIG. 2C.

A firearm retaining mechanism 48 is located on the interior side 40 of the door 16 and configured to releasably hold at least one firearm thereto, such as guns 12 and 14 in FIG. 1. Shown here as an example in FIG. 1 is an adjustable clamp system 50 wherein the firearm retaining mechanism 48 is configured to hold at least one long gun releasably and mechanically thereto. The firearm retaining mechanism 48 can be configured to rigidly hold the firearm, such as with the adjustable clamp system 50, or can loosely hold at least one long gun such that the long gun can be substantially vertically extracted therefrom, such as in an open holster affixed to the interior side 40 of the door 16. The direction of vertical extraction of the gun from the open door 16 is shown as Arrow A in FIG. 2C.

As shown in FIG. 1, the retaining mechanism 48 includes door-mount interface 100 that is configured to couple an adjustable mount system, such as the adjustable clamp system 50 (see FIG. 1) or the adjustable hook-and-loop system 130 or 166 (see FIGS. 4 and 5), to the inside surface 40 of the door 16 without exposing fasteners to the outside surface 42 of the door 16. As also shown in FIG. 1, the door-mount interface 100 is configured to facilitate selective adjustment of the vertical position at which the adjustable mount system is coupled to the inside surface of the door 16 (i.e., selective adjustment of the elevation of the adjustable mount system relative to the door 16). As further shown in FIG. 1, the adjustable mount system is configured to facilitate selective adjustment of the vertical and horizontal positions at which a firearm holder, such as a clamp, holster, or strap, is coupled to the adjustable mount system (i.e., selective adjustment of the elevation of the firearm holder relative to the adjustable mount system and selective adjustment of the horizontal position of the firearm holder relative to the adjustable mount system). The firearm holder is configured to hold handguns or long guns, such as the shotgun 12 or the rifle 14. Accordingly, the safe 10 facilitates an increased variety of selective adjustable mounting positions for a wide variety of firearm types and quantities.

In the embodiment of FIG. 1, the door-mount interface 100 includes a pair of bars 102, 104 welded to the inside surface 40 of the door 16, and the bars 102, 104 each have a plurality of threaded holes, such as the threaded hole 106, configured to receive fasteners, such as the fasteners 108, 110, to facilitate fastening the adjustable mount system to the bars 102, 104 using a selected one or more of the holes, thereby enabling selecting the vertical position of the adjustable mount system relative to the door 16. In the embodiment of FIG. 1, the adjustable mount system includes the adjustable clamp system 50, which includes a set of rails 112 that are configured to couple to the bars 102, 104. The set of rails 112 are configured to receive firearm holders, such as the clamps 114, 116, at selective vertical and horizontal positions along the set of rails 112. The firearm holders are configured to couple to the set of rails 112 and to hold handguns or long guns, such as the shotgun 12 or the rifle 14.

Figure 4:
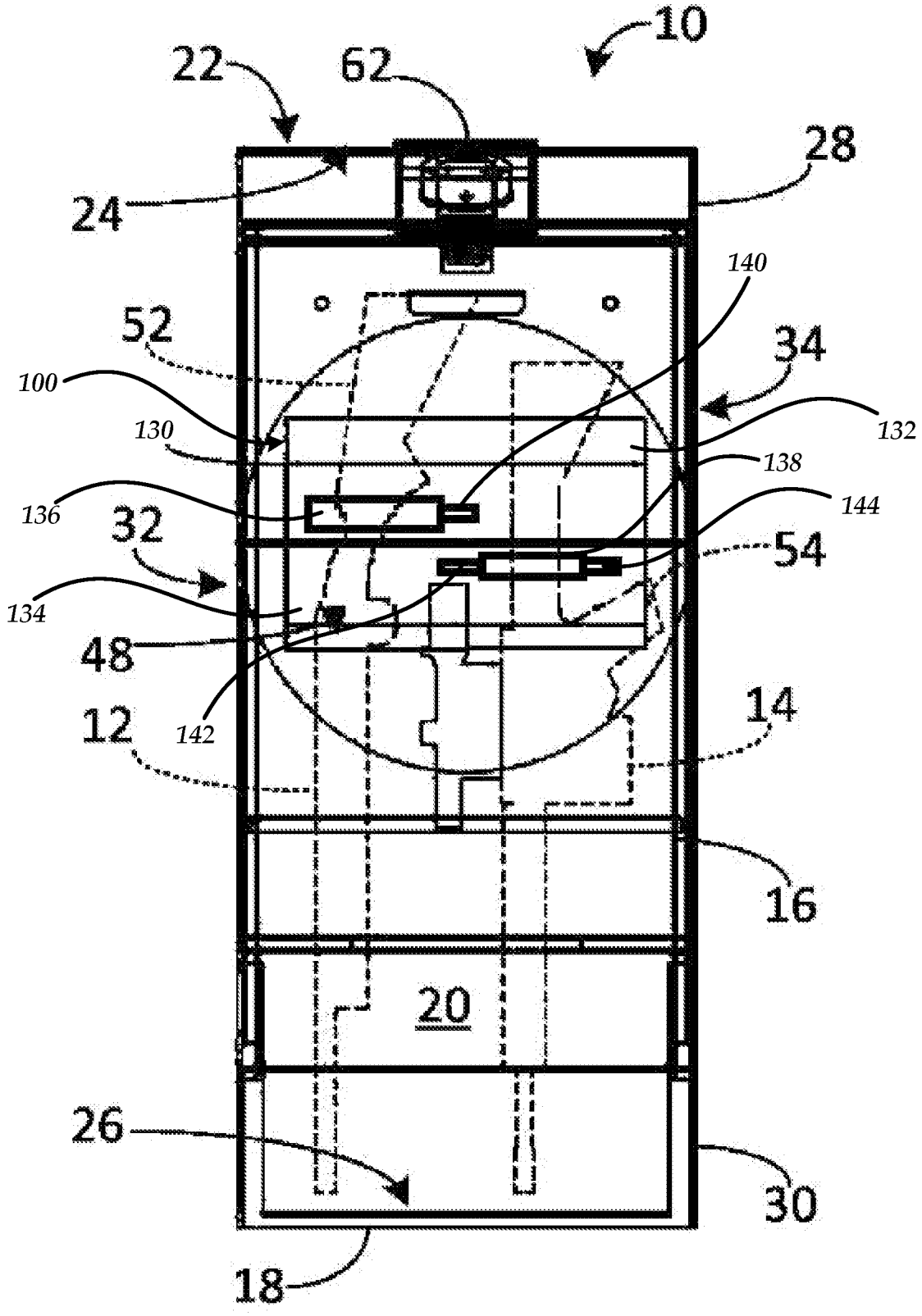
FIG. 4 is a front see-through view of a second embodiment of a rapid access gun safe, with the long guns illustrated as being held in position on the door of the safe.
Figure 5:
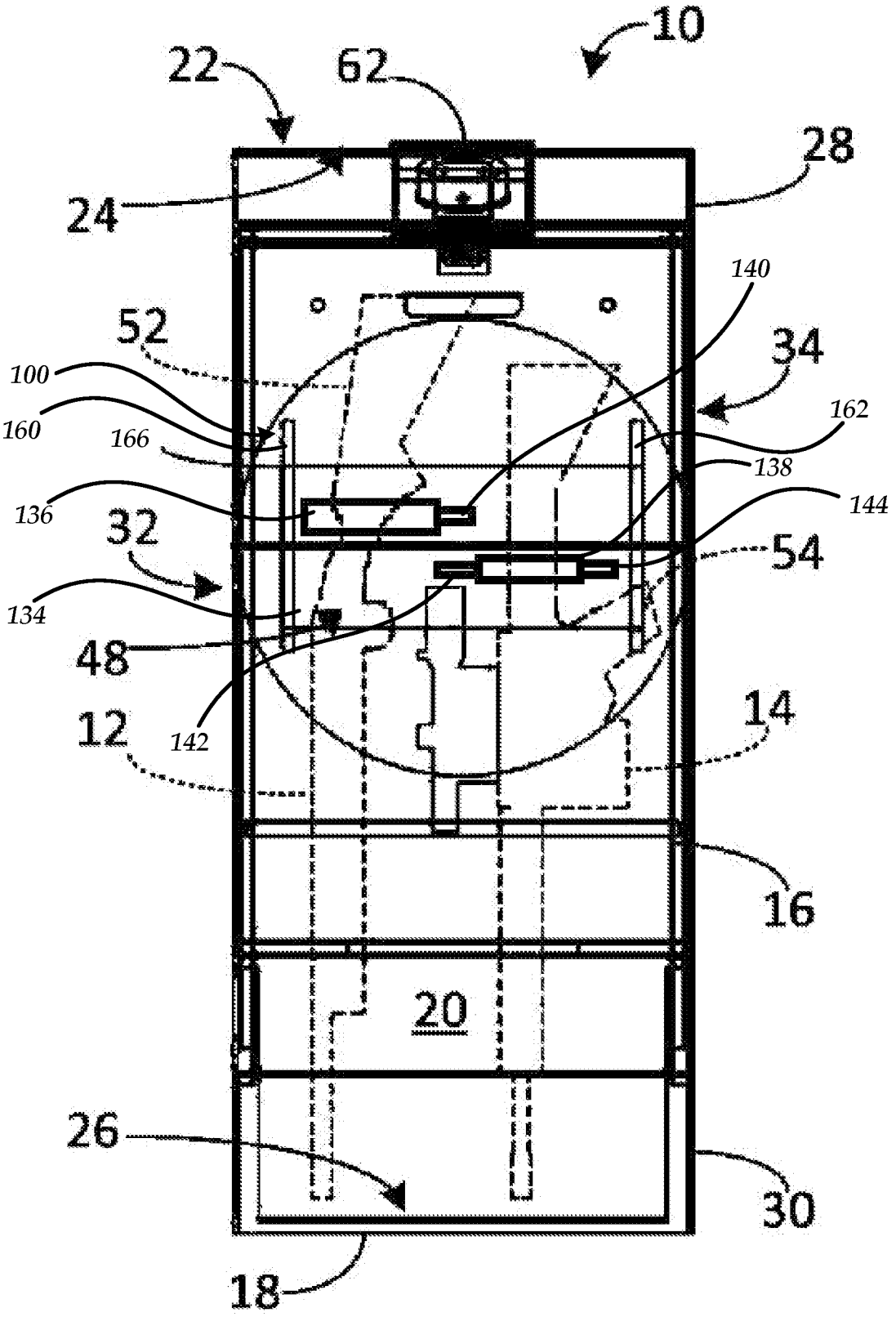
FIG. 5 is a front see-through view of a third embodiment of a rapid access gun safe, with the long guns illustrated as being held in position on the door of the safe.

In the embodiment of FIG. 4, the door-mount interface 100 includes a sheet 132 adhered to the inside surface 40 of the door 16. In the embodiment of FIG. 5, the door-mount interface 100 includes a pair of bars 160, 162 welded to the inside surface 40 of the door 16, and the bars 160, 162 each have a strip (not shown) adhered along the length of the side of the bars 160, 162 that is opposite the door 16. The sheet 132 or each of the strips has a plurality of one of hooks or loops, such as found in hook-and-loop fasteners, to facilitate fastening the adjustable mount system to the sheet 132 or strips at a variety of selectable positions, thereby enabling selecting the vertical position of the adjustable mount system relative to the door 16. In the embodiments of FIGS. 4 and 5, the adjustable mount system includes the hook-and-loop system 130 or the hook-and-loop system 166, each of which includes a panel 134 that includes the other of hooks or loops on the side of the panel 134 that faces the inside surface 40 of the door 16 and thus is configured to couple to the sheet 132 or the strips. In the embodiment of FIG. 4, the sheet 132 is larger than the panel 134 in at least one dimension, such as the vertical dimension, and is thus configured to facilitate selectively positioning the panel 134 at a variety of heights. In the embodiment of FIG. 5, the strips are longer in at least one dimension than the corresponding dimension of the panel 134, such as the vertical dimension, and are thus configured to facilitate selectively positioning the panel 134 at a variety of heights. The opposite side of the panel 134 (i.e., the side of the panel 134 that faces away from the door 16) includes one of hooks or loops (i.e., the opposite sides of the panel 134 may include the same or different ones of hooks or loops as each other), and the firearm holders, such as the straps 136, 138, have the other of hooks or loops and are thus configured to couple to the panel 134 and to hold handguns or long guns, such as the shotgun 12 or the rifle 14. The straps 136, 138 preferably have grips, such as the flaps 140, 142, 144, that are devoid of hooks or loops of hook-and-loop fasteners to facilitate pulling the straps 136, 138 off the panel 134. The panel preferably includes foam between the outer layers of hooks or loops and, in some embodiments, includes a rigid plate such that the foam is disposed between the plate and the outer layers of hooks or loops.

The safe is particularly advantageous to accommodate long guns such as long guns 12 and 14 and provide rapid access thereto by presenting the stock (stock 52 of shotgun 12) or pistol grip (grip 54 of assault rifle 14) of the long gun immediately to a person opening the door of the safe. In that embodiment, the person accessing the safe 10 can properly grasp the gun and/or trigger and use the firearm immediately after being pulled out of the safe 10. In other embodiments, such as that shown in FIGS. 2A to 2C, the upper part of the long gun, such as the barrel grip/guard 56 on shotgun 58, is the part of the gun immediately available for a person to grasp. The guns within the safe can have ammunition stored on them, such as ammunition holder 60 on shotgun 58, or the gun can be stored loaded or unloaded.

Figure 2A:
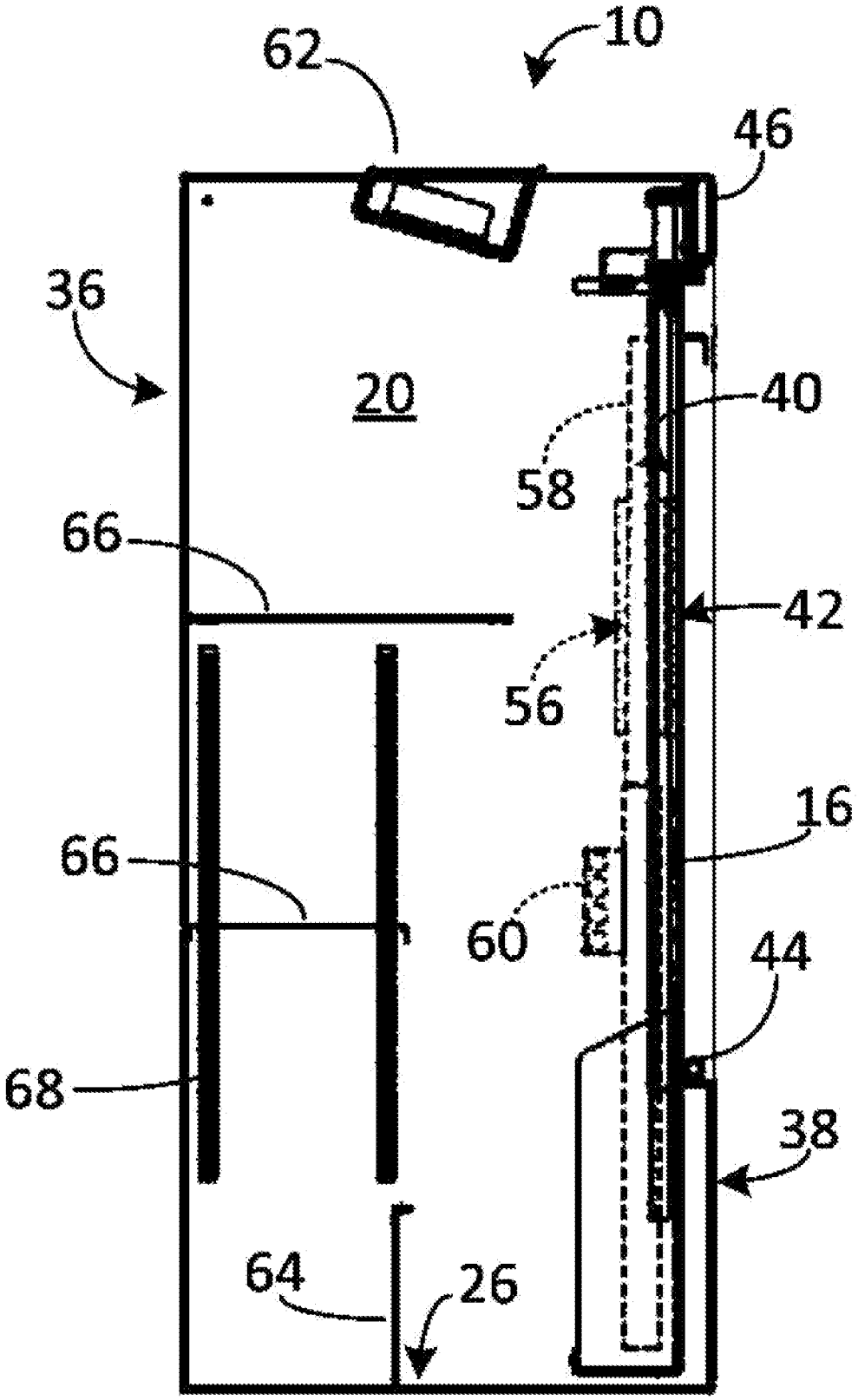
FIG. 2A is a side see-through view of the safe of FIG. 1, illustrating the top view of a shotgun being held on the door.

In the embodiment of FIG. 2A, a locking mechanism 46 is integrated into the upper portion 28 of the body 18 and accessible from the exterior surface 22 of the body 18. The locking mechanism 46 has at least an activation state wherein the locking mechanism 46 selectively holds the door 16 firmly against the body 18 thereby securely enclosing the interior storage compartment 20, i.e. a lock holds the door 16 in place, and a deactivation state wherein the door 16 is releasable from the body 18, i.e. the door 16 can either fall open, be automatically pushed open, or pulled open. In this embodiment, the locking mechanism 46 is configured to receive data for entering at least the deactivation state automatically, and can receive this data from an input pad 62.

The input pad 62 is on the exterior surface 22 of the upper portion 28 of the body 18 and located separately from the locking mechanism 46 in this embodiment. It should be appreciated that the input pad can be placed anywhere on the body 18 of the safe 10. Alternately, the input pad 62 can be physically integrated with the locking mechanism 46 and being in the same physical unit. The input pad 62 is configured to accept user input and is communicatively connected to the locking mechanism 46 in this embodiment to selectively communicate data thereto to cause the locking mechanism 46 to at least enter the deactivation state, i.e. allow the door 16 to be opened. The user input data can be in almost any form of physical interaction by a person with the input pad 62, such as a numeric code, sequence of mechanical actions, a physical key, or an electronic proximity detection such as a specialized ring or bracelet worn by a person. The main attribute to consider for the input data needed to open the safe 10 is speed of the action needed to open the door 16 by an authorized individual. Consequently biometric data or numeric code input are preferable methods of collecting user input.

Thus, in one embodiment, the input pad 62 is a biometric data collector and the user input is biometric data, such as a fingerprint reader, iris scanner, or other biometric data gathering device. In such manner, only a person having the correct biometric data can open the door 16. In an alternate embodiment, the input pad 62 is configured to receive a code input by a user, such as the input of a simple 4 or 6 digit number.

Figure 2B:
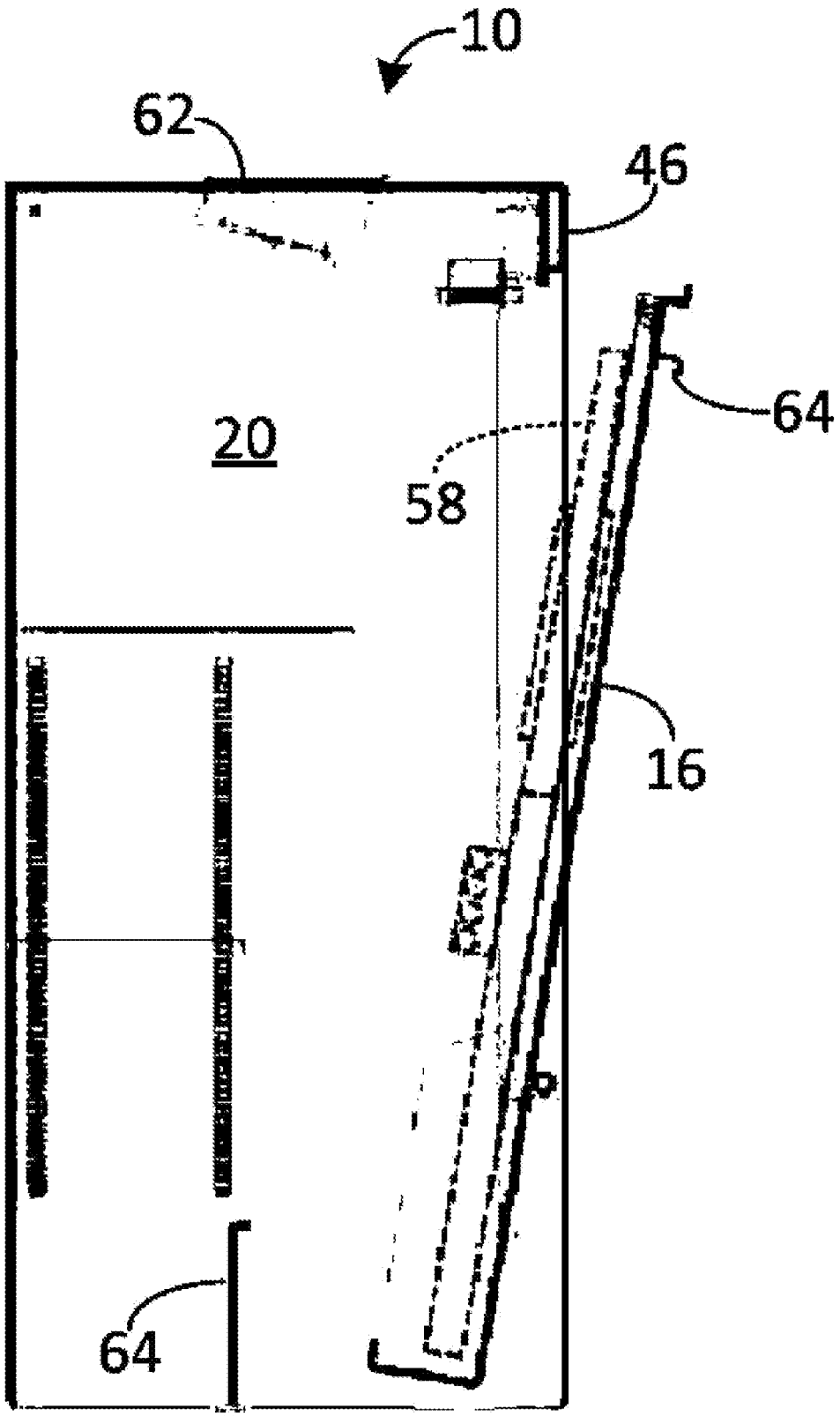
FIG. 2B is a side-see through view of the safe in FIG. 2A, with the door partially opened and a long gun shown in situ on the door.
Figure 2C:
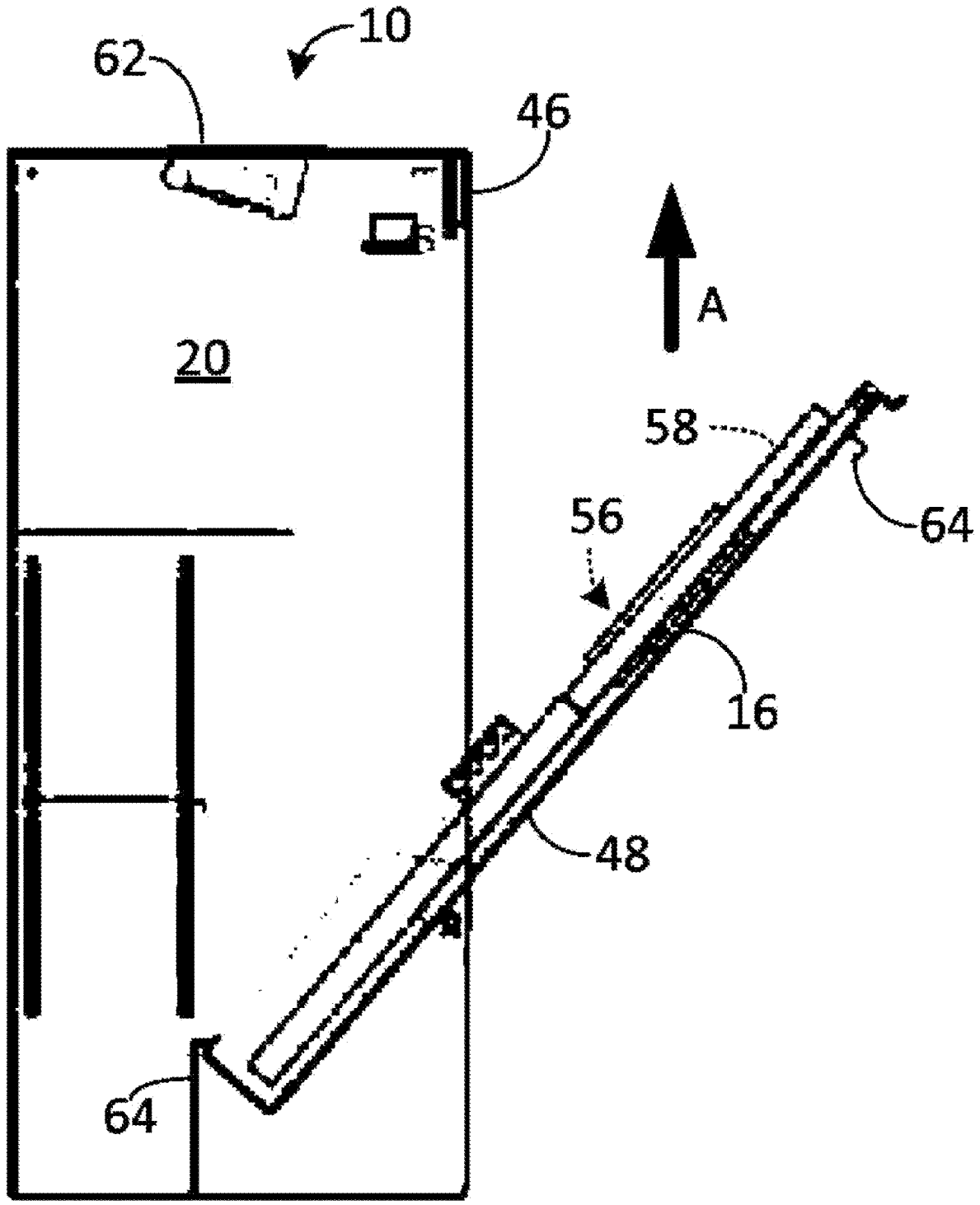
FIG. 2C is a side see-though view of the safe in FIGS. 2A and 2B, with the door fully opened.

Given the need to immediately access the firearms, it is preferable that the door 16 automatically opens upon release from the locking mechanism 46. Thus, as shown in FIGS. 2A to 2C, the door 16 will fall open from the upper portion 28 of the body 18. FIG. 2A is a side see-through view of the safe of FIG. 1, which shows an outline of a shot gun 58 as being physically held against the door 16. The input pad 62, here a biometric lock, can be seen on the top wall 22 of the safe. FIG. 2B is a side see-through view of the safe 10, with the door 16 partially opened and the shotgun 58 shown in situ on the door. FIG. 2C is a side see-through view of the safe in FIG. 2B, with the door 16 fully opened.

The safe 10 can automatically be open via a spring or other mechanical motivator on door 16 once the lock mechanism is deactivated, which will aid in the access time to the guns. Alternatively, the door 16 could be manually pulled open by the user upon release of the door 16 from the locking mechanism 46, and the door can have a grip or handle, such as protuberance 64 (FIGS. 2B-C) on its exterior side 42 to allow a user to pull on the door 16 to open it.

As shown in the embodiment of FIGS. 2A to 2C, there is a stop 64 on the bottom wall 26 that stops the door 16 at a predetermined point in its extension from the upper portion 28 from the body 18. The door 16 can be seen as resting against the stop 64 in FIG. 2C with the door 16 fully open.

Also in the embodiment of FIGS. 2A to 2C, the interior storage compartment 20 of the safe 10 can also contain storage space, such as one or more shelves 66. In this embodiment, there are shelf holders 68 on the side walls 32 and 34 that allow shelves 66 to be selectively positioned within the interior storage compartment 20. Thus, other valuable items can be placed within the safe 10, or other firearms, such as pistols, or ammunition can likewise be placed on the shelves and accessible only when the door 16 is open.

Figure 3:
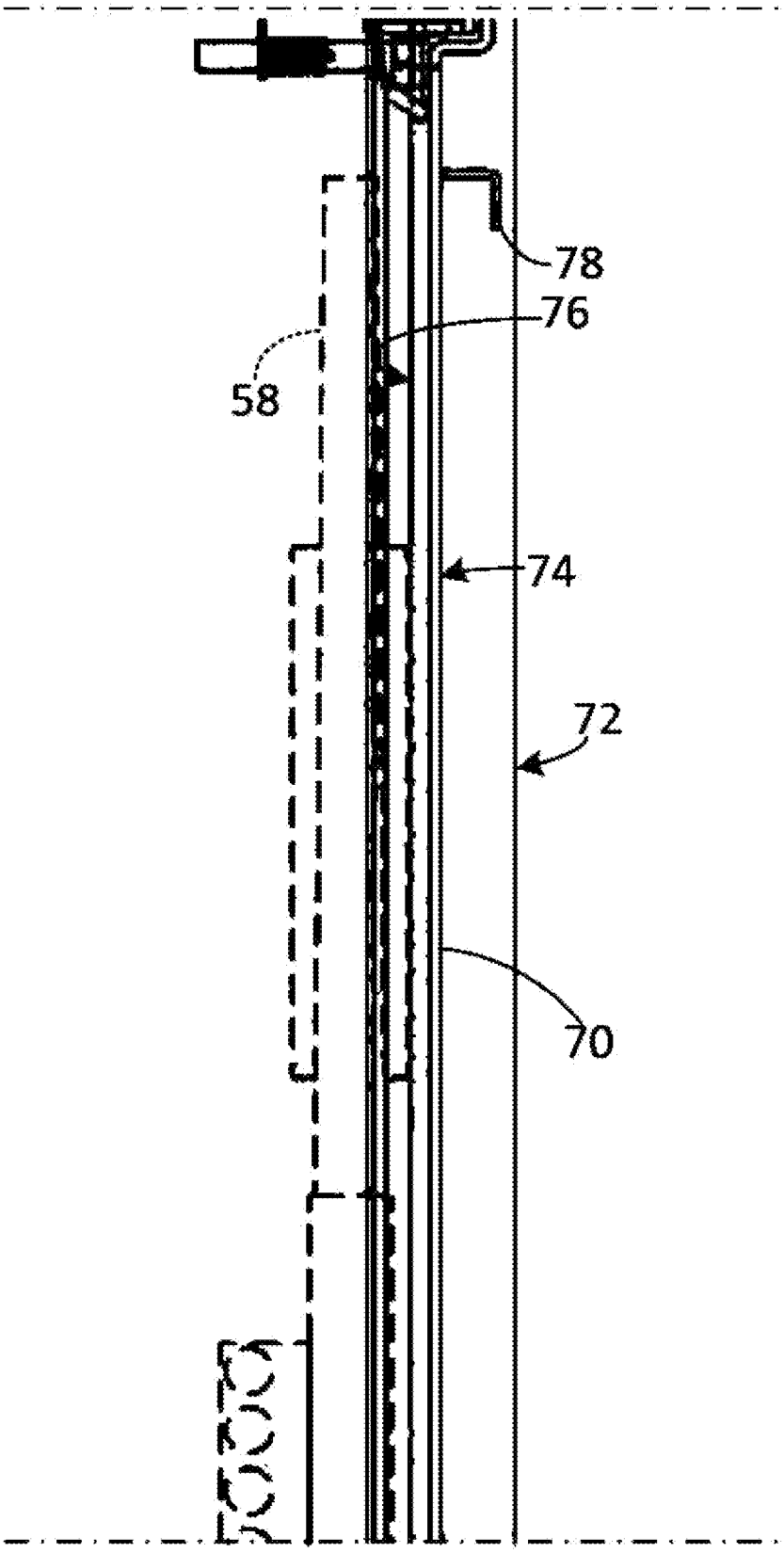
FIG. 3 is a cross-section of the door of the safe in one embodiment with the door recessed from the side wall of the body.

FIG. 3 is a cross-section of the door 70 of the safe in one-embodiment with the door 70 recessed from the side wall 72 of the body 18. Thus, the outer surface 74 of the door 70 is set back from the outer side wall 72 such that the locking mechanism handle 78 is held within the recess. The shotgun 58 is held to the interior side 76 of the door 70 in the same potential manner as described above, such as either with a clamp or holster. It can thus be seen that the door 70 can be embodied as recessed, flush, or resting outside from the side wall 72.

While the invention has been described above in several embodiments, it is to be understood that this description is not intended to limit the spirit and scope of this invention as is particularly set forth in the claims below.

What is claimed is:

1. A rapid access firearm safe, comprising:

a rigid body having an interior storage compartment and an exterior surface;

a door within the body, the door defining a barrier portion, the barrier portion having an interior side thereof facing the interior storage compartment and an exterior side thereof;

a lock configured to selectively lock the door in a closed configuration relative to the body and to selectively unlock the door to enable the door to transition to an open configuration in which the door is free to move relative to the body;

a firearm holder configured to selectively hold a firearm in the interior storage compartment;

an adjustable mount system configured to selectively receive and secure the firearm holder at a variety of selectable positions on the adjustable mount system; and a door-mount interface coupled to the door and configured to selectively receive and secure the adjustable mount system to the interior side of the barrier portion at a variety of selectable positions on the door-mount interface, whereby a variety of adjustable mounting positions for the firearm on the barrier portion is increased.

2. The safe of claim 1, wherein the door defines a floor portion, the floor portion extending into the interior storage compartment from the barrier portion of the door and being configured to move with the barrier portion when the door swings open.

3. The safe of claim 2, wherein the body has an upper portion and a lower portion, the door being hingedly attached to the lower portion of the body such that the door swings open from the upper portion of the body.

4. The safe of claim 3, wherein the firearm holder has a first one of hooks or loops, and the adjustable mount system has a second one of hooks or loops, the second one of hooks or loops being different than the first one of hooks or loops, the first one of hooks or loops and the second one of hooks or loops forming hook-and-loop fasteners that are configured to selectively couple the firearm holder to the adjustable mount system.

5. The safe of claim 4, wherein the adjustable mount system has a third one of hooks or loops, and the door-mount interface has a fourth one of hooks or loops, the fourth one of hooks or loops being different than the third one of hooks or loops, the third one of hooks or loops and the fourth one of hooks or loops forming hook-and-loop fasteners that are configured to selectively couple the adjustable mount system to the door-mount interface.

6. The safe of claim 4, wherein the firearm holder includes a holster or cup, the holster or cup being configured to removably hold a handgun.

7. The safe of claim 4, wherein the firearm holder includes a strap, the strap being configured to extend across a stock end portion of the firearm with opposite end portions of the strap coupled to the adjustable mount system to removably hold the firearm.

8. The safe of claim 7, wherein the firearm is a shotgun or rifle, and no portion of the safe is configured to clamp or grip a barrel of the shotgun or rifle.

9. The safe of claim 8, wherein the floor portion of the door is disposed below a barrel of the firearm and is configured to shield a distal opening in the barrel of the firearm from contents in the interior storage compartment as the door swings open.

10. The safe of claim 1, wherein the adjustable mount system is larger than the firearm holder in at least one dimension, whereby a variety of adjustable mounting positions of the firearm holder on the adjustable mount system is increased, thereby increasing a variety of adjustable mounting positions for the firearm on the barrier portion.

11. The safe of claim 10, wherein the door-mount interface is larger than the adjustable mount system in at least one dimension, whereby a variety of adjustable mounting positions of the adjustable mount system on the door-mount interface is increased, thereby increasing a variety of adjustable mounting positions for the firearm on the barrier portion.

12. The safe of claim 1, wherein the door is spring biased toward the open configuration, whereby the door automatically opens responsive to unlocking the lock.

* * * * *